US008215514B2

(12) United States Patent
Morenstein et al.

(10) Patent No.: US 8,215,514 B2
(45) Date of Patent: Jul. 10, 2012

(54) LID AND CONTAINER

(75) Inventors: Joshua Morenstein, San Francisco, CA (US); Vivian Brand, San Francisco, CA (US); Brian Cutter, San Francisco, CA (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/091,955

(22) Filed: Apr. 21, 2011

(65) Prior Publication Data

US 2011/0200716 A1 Aug. 18, 2011

Related U.S. Application Data

(63) Continuation of application No. 12/112,540, filed on Apr. 30, 2008, now Pat. No. 7,963,416.

(60) Provisional application No. 60/914,892, filed on Apr. 30, 2007.

(51) Int. Cl.
*B65D 61/00* (2006.01)

(52) U.S. Cl. ..... 220/376; 220/377; 220/810; 220/212; 206/459.1; 206/459.5

(58) Field of Classification Search ..... 220/376, 220/377, 810, 845, 847, 793, 805, 212, 796, 220/213; 206/459.1, 459.5, 769
See application file for complete search history.

(56) References Cited

U.S. PATENT DOCUMENTS

| | | | | |
|---|---|---|---|---|
| D28,413 | S | 3/1898 | Taite | |
| 1,884,132 | A | 10/1932 | Nelson | |
| 2,939,603 | A | 6/1960 | Young | |
| 3,412,890 | A | 11/1968 | Rich | |
| 3,417,897 | A | 12/1968 | Johnson | |
| 3,421,654 | A | 1/1969 | Hexel | |
| 3,640,018 | A | 2/1972 | Light | |
| 3,701,456 | A * | 10/1972 | Alroy et al. | 206/520 |
| 3,811,211 | A | 5/1974 | Morgan | |
| 4,091,927 | A | 5/1978 | Lunsford | |
| 4,252,247 | A * | 2/1981 | Asbury | 220/268 |
| 4,360,119 | A | 11/1982 | Olivo | |
| 4,488,667 | A * | 12/1984 | Swett et al. | 222/485 |
| 4,699,290 | A | 10/1987 | Adams | |
| 4,815,607 | A * | 3/1989 | Agapiou | 206/579 |
| 4,819,829 | A | 4/1989 | Rosten et al. | |

(Continued)

OTHER PUBLICATIONS

U.S. Appl. No. 29/296,933, filed Oct. 31, 2007, 71 pages.

*Primary Examiner* — Mickey Yu
*Assistant Examiner* — Kareen Rush
(74) *Attorney, Agent, or Firm* — Griffiths & Seaton PLLC

(57) ABSTRACT

A container lid comprises a top, substantially planar surface, means for coupling with a top of a container, a depressed area, a raised area, and a hinge area. The top, substantially planar surface is elongated to define two opposite longitudinal edges and two opposite lateral edges, and each of the two opposite lateral edges extends between and is shorter than each of the two longitudinal edges. The depressed area is surrounded by and extends below the top, substantially planar surface. The raised area is surrounded by and extends above the top, substantially planar surface. The raised area is positioned nearest one of the two opposite lateral edges and the depressed area is positioned nearest the other one of the two opposite lateral edges. The hinge area extends laterally across the top, substantially planar surface and is positioned between the depressed area and the raised area.

22 Claims, 7 Drawing Sheets

U.S. PATENT DOCUMENTS

D351,087 S 10/1994 Anderson
5,392,945 A 2/1995 Syrek
5,398,908 A 3/1995 Kienle
5,427,266 A 6/1995 Yun
5,507,389 A 4/1996 Syrek
D376,952 S 12/1996 Rausch
D389,012 S 1/1998 Miller
5,794,768 A 8/1998 Skeffington et al.
D403,582 S 1/1999 Nask et al.
5,896,993 A 4/1999 Nask et al.
D417,584 S 12/1999 Lillelund et al.
D417,817 S 12/1999 Loew et al.
6,070,751 A * 6/2000 Mejias ..... 220/253
6,079,587 A 6/2000 Vogt
6,216,904 B1 4/2001 Cagan
D445,687 S 7/2001 Gilbertson
6,257,400 B1 * 7/2001 Woodhouse ..... 206/69
D448,969 S 10/2001 Conti
6,412,637 B1 7/2002 Saunders et al.
6,523,713 B1 2/2003 Helms
6,568,534 B2 5/2003 Zank
D480,264 S 10/2003 de Groote et al.
6,868,980 B2 3/2005 Schultz et al.
D504,053 S 4/2005 Bertulis
6,910,623 B2 6/2005 Stewart et al.
6,929,143 B2 8/2005 Mazzarolo
D512,914 S 12/2005 Moretti
7,134,570 B1 11/2006 Heath et al.
7,165,695 B2 1/2007 Choi
D548,538 S 8/2007 Liu
D550,503 S 9/2007 Liu
D551,515 S 9/2007 Ablo et al.
7,275,652 B2 10/2007 Morris et al.
7,318,536 B2 1/2008 Maravich et al.
D564,287 S 3/2008 Bouveret et al.
D568,739 S 5/2008 Darr
D575,100 S 8/2008 Liu
D586,179 S 2/2009 Furlong
D589,341 S 3/2009 Busse et al.
D595,085 S 6/2009 Carlson
D602,734 S 10/2009 de Groote
D641,208 S 7/2011 Morenstein et al.
D642,053 S 7/2011 Samartgis
D642,459 S 8/2011 Samartgis
D642,460 S 8/2011 Samartgis
D642,461 S 8/2011 Samartgis
D642,462 S 8/2011 Samartgis
8,011,566 B2 9/2011 Robertson et al.
2004/0206765 A1 10/2004 McMahon, III et al.
2005/0092749 A1 5/2005 Durdon
2005/0092763 A1 * 5/2005 Haggerty et al. ..... 220/912
2005/0224497 A1 * 10/2005 Wook ..... 220/269
2005/0224505 A1 10/2005 Brown et al.
2006/0181515 A1 8/2006 Fletcher et al.
2006/0214417 A1 9/2006 Wescott et al.
2007/0131694 A1 * 6/2007 Moran et al. ..... 220/376
2008/0264947 A1 10/2008 Morenstein et al.
2009/0020546 A1 1/2009 Kiehne

* cited by examiner

LID AND CONTAINER

CROSS-REFERENCE TO RELATED APPLICATIONS

The present application is a Continuation of U.S. application Ser. No. 12/112,540, filed Apr. 30, 2008, which is a non-provisional of U.S. Provisional Application No. 60/914,892, filed Apr. 30, 2007, both of which are incorporated herein by reference.

BACKGROUND OF THE INVENTION

Food packaging serves many purposes including protecting food from contamination and spoilage, allowing food to be stacked on shelving in retail stores, providing easy access to the food within the packaging after purchase, conveying information about the food to consumers and attracting the attention of consumers to increase the likelihood that they will purchase the food.

Some food packaging includes a paper or cardboard container with a plastic lid. To allow for easy stacking, the plastic lids have relatively flat tops with at most a raised outside ridge line along the perimeter and perhaps a slightly raised logo on the interior of the lid. Because food packaging is placed on shelving, most of the packaging is viewed from a side angle. As a result, consumers are not given a good view of the lids when shopping. Because of this, the lids have not performed well at attracting the attention of consumers. In addition, the relatively flat lids are not ideal at conveying information to the consumer because the text or logo information on the lid is not presented in such a way as to be readily apparent to the consumer. In particular, since most plastic lids are a single color, the text and logo information tends to be difficult to differentiate from the other parts of the lid unless the consumer is specifically looking for the logo or text.

The discussion above is merely provided for general background information and is not intended to be used as an aid in determining the scope of the claimed subject matter.

SUMMARY

A food package has a container and a lid. The lid comprises a top, substantially planar surface, means for coupling with a top of a container, a depressed area, a raised area, and a hinge area. The top, substantially planar surface is elongated to define two opposite longitudinal edges and two opposite lateral edges. Each of the two opposite lateral edges extends between and is shorter than each of the two longitudinal edges. The means for coupling extends downwardly and around from a periphery of the top, substantially planar surface. The depressed area is surrounded by and extends below the top, substantially planar surface. The raised area is surrounded by and extends above the top, substantially planar surface. The raised area is positioned nearest one of the two opposite lateral edges and the depressed area is positioned nearest the other one of the two opposite lateral edges. The hinge area extends laterally across the top, substantially planar surface and is positioned between the depressed area and the raised area.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

Embodiments of the invention will be described with respect to the figures, in which like reference numerals denote like elements, and in which.

DETAILED DESCRIPTION

Embodiments described herein provide a food container with a lid for distributing, marketing, and consuming food products. For example, the packaging is well suited for use with dry cereal. The lid includes structures that attract consumers' attention and that help to convey information to the consumer. Under one particular embodiment, the structures include a convex dome with a clear window that rises above the remainder of the lid so that it can be seen easily by consumers passing a shelf containing the food package. The visible clear window on the dome encourages consumers to try to look through the window to see if they can view the contents of the packaging. Thus, the consumer's attention is drawn to the packaging by the clear window. Under further embodiments, logo and text information is framed by placing the logo or text in a concave dome, which draws the consumer's attention to the logo or text. This makes it easier for the lid to convey the information represented by the logo or text to the consumer. This concave dome has the added benefit of protecting the logo or text from abrasion, thereby improving its ability to convey information to the consumer.

In the discussion below, relative placement terms such as above, below, raised, lowered, top, bottom, front, back, and side are used. These terms are to be understood as being relative to the orientation of the structures shown in the attached drawings and relative to each other.

Figure 1:
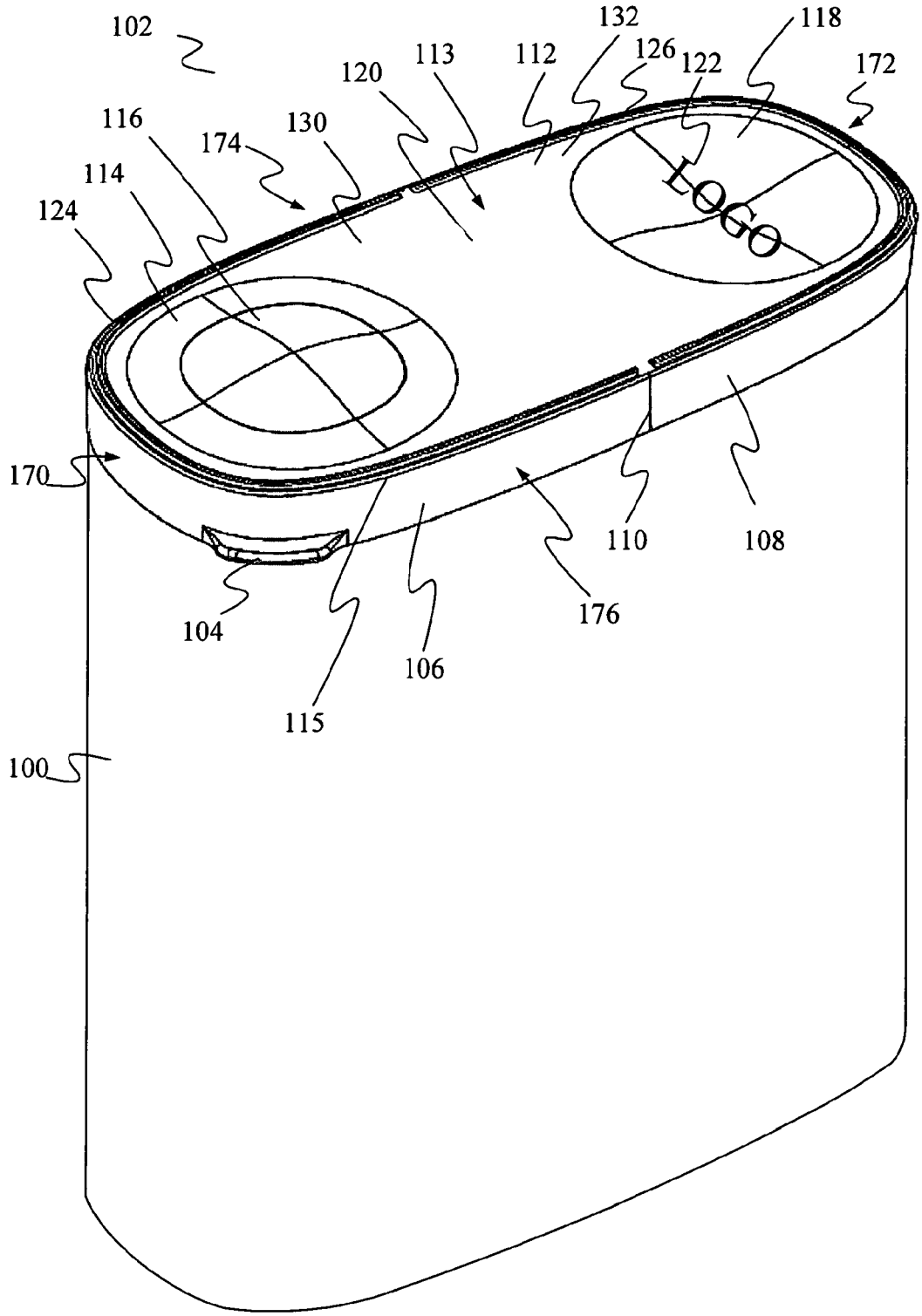
FIG. 1 is a perspective view of a food container with lid, under one embodiment.

FIG. 1 provides a perspective view of a container 100 with a lid 102 used to contain food products. Lid 102 includes a front 170, a back 172, a side 174 and an opposite side 176. Lid 102 also includes a top area or region 112 that has a periphery 115 contiguous with and defined by skirts 106 and 108 that are separated by a slit 110.

Top area 112 includes a planar region or surface 113 that surrounds a concave or depressed area 118 and a convex or raised area 114 having a window 116. In the embodiment of FIG. 1, convex area 114 and concave area 118 are both oval shaped domes. However, in other embodiments, other shapes may be used for the convex and concave areas such as squares, triangles, pentagons and octagons, for example. In some of the Figures, lines are shown crossing convex area 114 and concave area 118 to provide a sense of the shapes of these areas. However, such lines are not present in the actual lid.

Planar region 113 includes a hinge area 120 that is aligned with slit 110 and that extends from side 176 to side 174 between convex area 114 and concave area 118. The portion of lid 102 between hinge area 120 and front 170 is referred to herein as front portion 180 and the portion of lid 102 between hinge area 120 and back 172 is referred to herein as back portion 182

Figure 2:
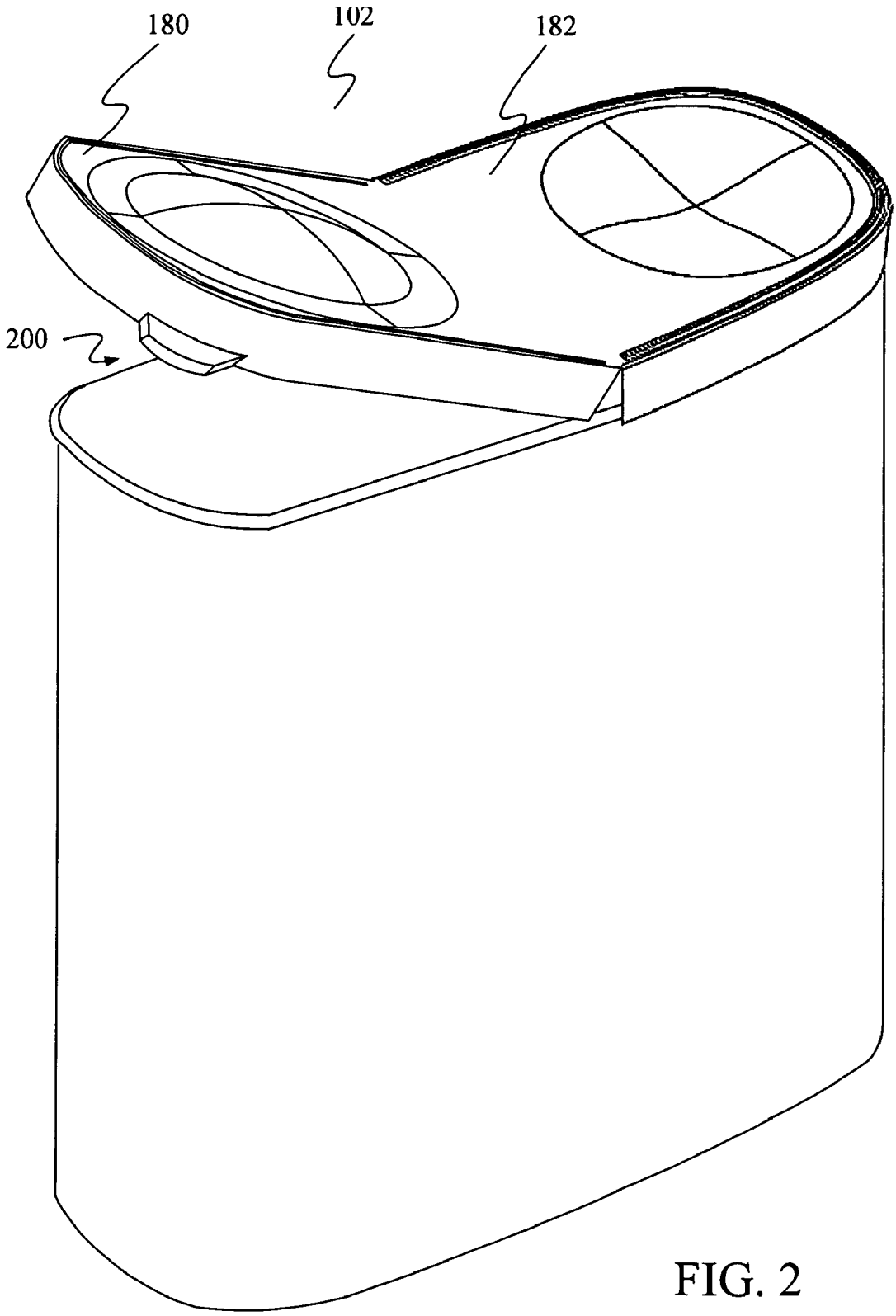
FIG. 2 is a perspective view of a lid and container with the lid hinged open under one embodiment.

By lifting on tab 104, a user is able to separate skirt 106 from skirt 108 along slit 110 by bending planar surface 113 along hinge area 120 as shown in FIG. 2. In FIG. 2, front portion 180 of the lid is detached from container 100 and is hinged relative to back portion 182, while back portion 182 remains attached to container 100. When lid 102 is hinged open in this configuration, an opening 200 is created between front portion 180 and container 100. The contents within container 100 may be extracted from container 100 by reaching into the container or by pouring the contents out of the container through opening 200.

Near periphery 115 of top area 112 are a ridge 124 on front portion 180 and a ridge 126 on back portion 182 which each terminate before hinge area 120. Under some embodiments, terminating before hinge area 120 includes terminating at the boundary of hinge area 120. Ridges 124 and 126 are raised relative to planar surface 113 but are not raised as high as the top of window 116 in convex dome 114. Ridges 124 and 126 provide a structure for fitting within the underside of another container that is stacked on top of lid 102 during shipping or during retail display.

Ridge 124 and hinge area 120 together define an interior region 130 on top area 112, where convex area 114 is located within interior region 130. Ridge 126 and hinge area 120 together define a second interior region 132 on top area 112, where concave area 118 is located within second interior region 132.

Concave area 118 includes a raised logo or text 122 that is formed as part of the lid and is raised relative to the surface of the concave area 118 but is below planar surface 113. Concave area 118 thereby frames logo 122, drawing the user's attention to the logo while also protecting the logo from wear.

Convex area 114 raises window 116 above planar surface 113 and ridges 124 and 126. Under one embodiment, window 116 is clear or transparent so that objects below lid 102 can be viewed from above lid 102. By raising this window above ridges 124 and 126, consumers can see the window when passing a display that contains the package. This allows consumers to notice that the dome is clear and thereby invites them to come closer to the packaging to view the contents below the window.

Figure 3:
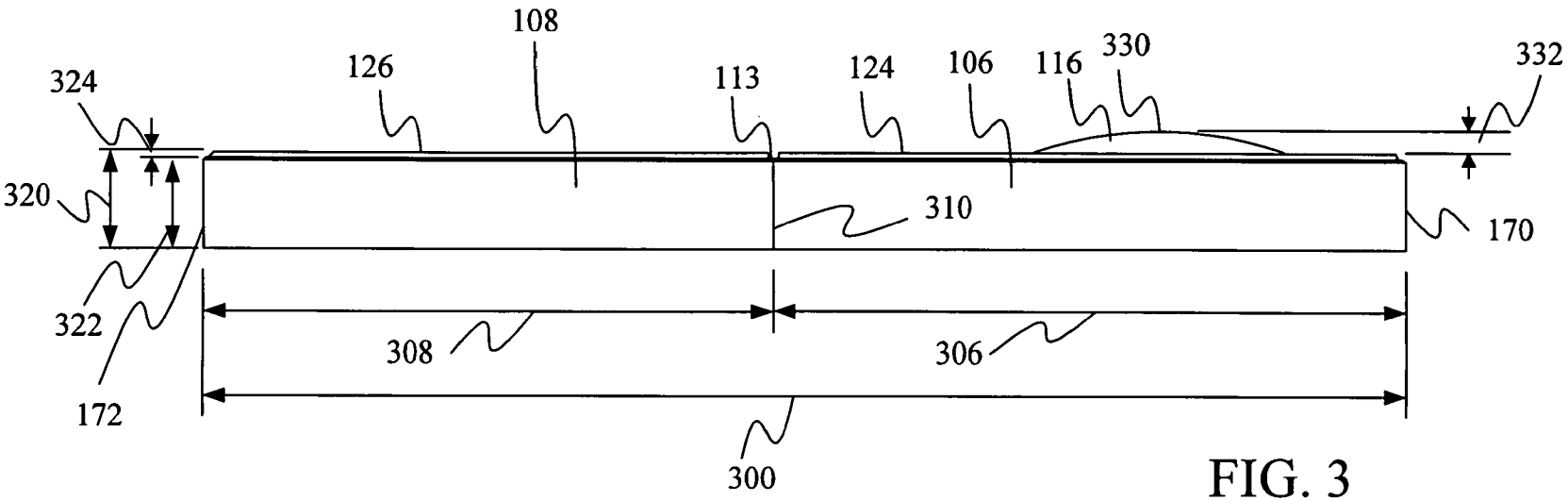
FIG. 3 is a side view of a lid under one embodiment.
Figure 4:
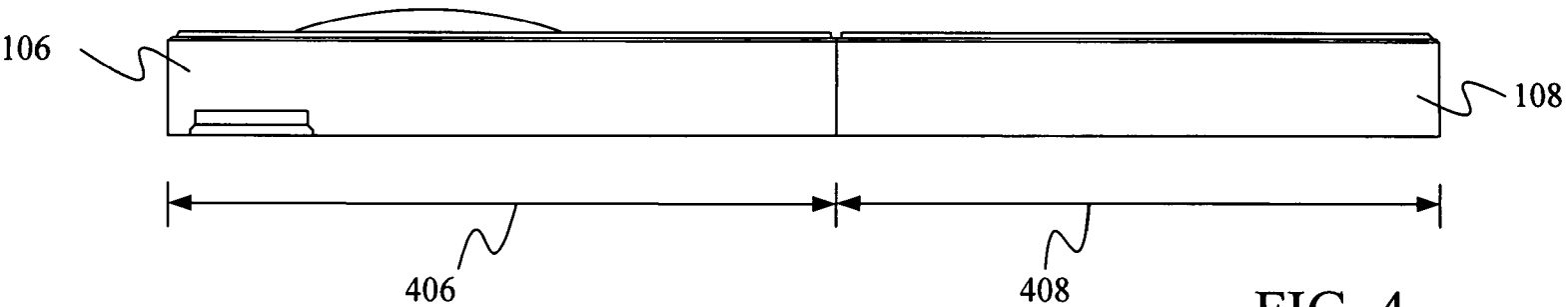
FIG. 4 is an opposite side view of the lid of FIG. 3.

FIGS. 3 and 4 show side views of lid 102. The side view of FIG. 3 shows skirt 106 and skirt 108 separated by a slit 310 and the side view of FIG. 4 shows skirt 106 and skirt 108 separated by slit 110. Lid 102 has a length 300 measured from front end 170 to back end 172, which under one embodiment is 6.15 inches. Skirt 106 has a length 306 from front end 170 to slit 310 and skirt 108 has a length 308 from slit 310 to back end 172. Under one embodiment, length 306 is 3.193 inches and length 308 is 2.957 inches. As such, slit 310 is not centered between front end 170 and back end 172. In FIG. 4, skirt 106 has a length 406 and skirt 108 has a length 408 that are the same as lengths 306 and 308, respectively. However, in other embodiments, length 406 may be different from length 306 resulting in a hinge area that runs diagonally across lid 102.

Lid 102 has a height 320 from the bottom of skirt 108 to the top of ridge 126. This height is the same as the height from the bottom of skirt 106 to the top of ridge 124. Under one embodiment, height 320 is 0.51 inches. Planar surface 113 is a height 322 from the bottom of skirt 108 and skirt 106. Under one embodiment, height 322 is 0.479 inches. The tops of ridges 124 and 126 are a height 324 above planar surface 113. Under one embodiment, height 324 is 0.031 inches.

Convex clear window 116 has a top 330 that is a height 332 above the top of ridge 124. Under one embodiment, height 332 is 0.125 inches. Because convex window 116 is above the top of ridge 124, it can be viewed by consumers even when the top of the lid is level with the consumer's eyes or above the consumer's eyes slightly. This allows consumers to recognize that lid 102 has a clear window through which items below the lid may be viewed.

Figure 5:
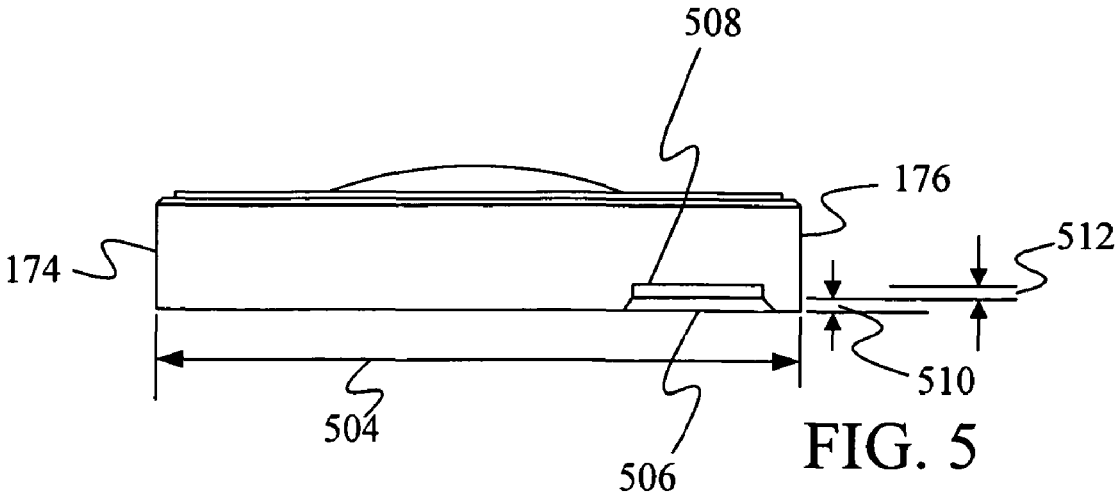
FIG. 5 is a front view of the lid of FIG. 3.
Figure 6:
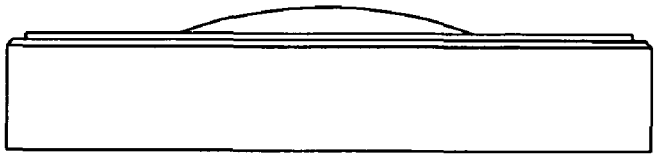
FIG. 6 is a back view of the lid of FIG. 3.

FIGS. 5 and 6 show a front view and a back view, respectively, of lid 102. Lid 102 has a width 504 from side 174 to side 176. Under one embodiment, width 504 is 2.656 inches.

In FIG. 5, tab 104 is shown as having a base portion 506 and a crown portion 508. Base portion 506 has a height 510 and crown portion 508 has a height 512. Under one embodiment, heights 510 and 512 are 0.06 inches each.

Figure 7:
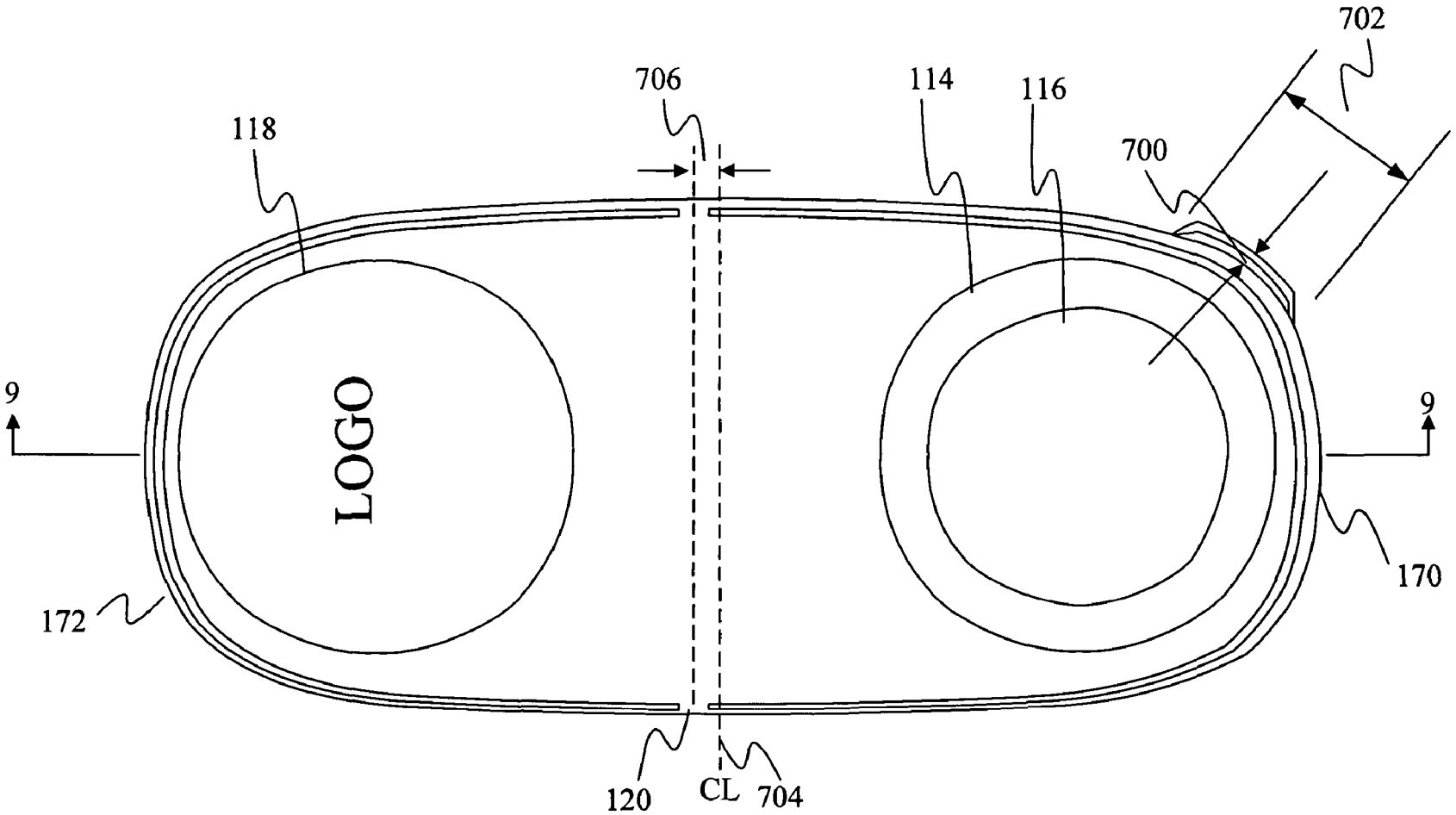
FIG. 7 is a top view of the lid of FIG. 3.
Figure 8:
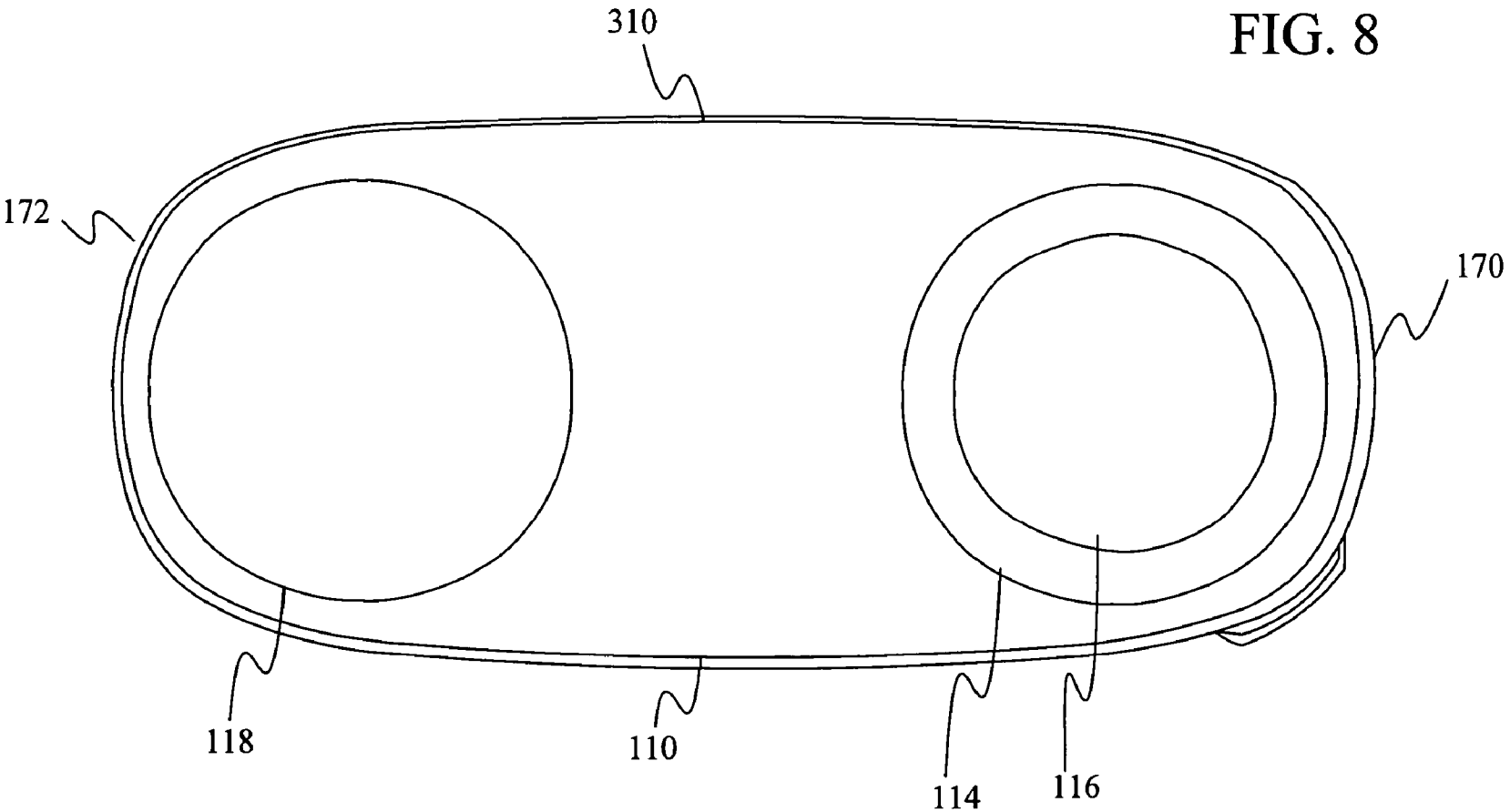
FIG. 8 is a bottom view of the lid of FIG. 3.

FIGS. 7 and 8 show a top view and a bottom view, respectively, of lid 102. In the embodiment of FIG. 7, lid 102 has an oval shape. In other embodiments, lid 102 may have a square or rectangular shape. In FIG. 7, tab 104 is shown to extend out from lid 102 by a distance 700, which under one embodiment is 0.1 inches. The tab extends along a distance 702, which under one embodiment is 0.9 inches.

Convex area 118 has an oval periphery. This oval periphery may be circular or consist of a set of different radial arcs. Similarly, convex area 114 and window 116 have an oval shape that may also be either circular or some other oval construct. In one particular set of embodiments, convex area 114 and concave area 118 are ovals defined by radii between 1.0312 inches and 1.0625 inches and window 116 is an oval defined by radii between 0.6875 inches and 0.71875 inches that is located concentrically within the oval that defines the periphery of convex area 114. In other embodiments, convex area 114 and concave area 116 may have a non-oval periphery. Under one embodiment, convex area 114 and concave area 118 have equal circumferences.

In FIG. 7, hinge area 120 is shown offset from a center line 704 by a distance 706, which under one embodiment is 0.118 inches. Center line 704 is halfway between front end 170 and a back end 172 of the lid.

Figure 9:
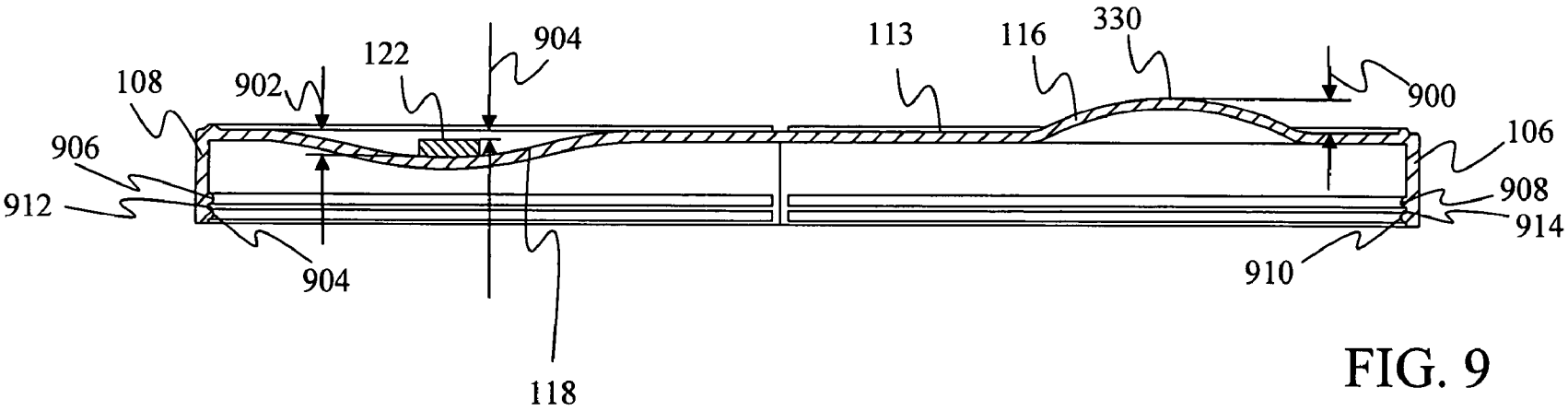
FIG. 9 is a cross sectional view of a lid of one embodiment.

FIG. 9 provides a cross-sectional view of lid 102 along lines 9-9 of FIG. 7. In FIG. 9, the top 330 of window 116 is shown to be a height 900 above planar surface 113. Under one embodiment, height 900 is 0.14 inches. Similarly, the top surface of the lowest point of concave area 118 is shown to be a distance 902 below planar surface 113. Distance 902 under one embodiment is 0.14 inches. Logo 122 is shown in concave area 118 to be raised relative to the top surface of concave area 118. However, the height of logo 122 is a distance 904 below planar surface 113. As a result, logo 122 is somewhat protected from contact.

Figure 10:
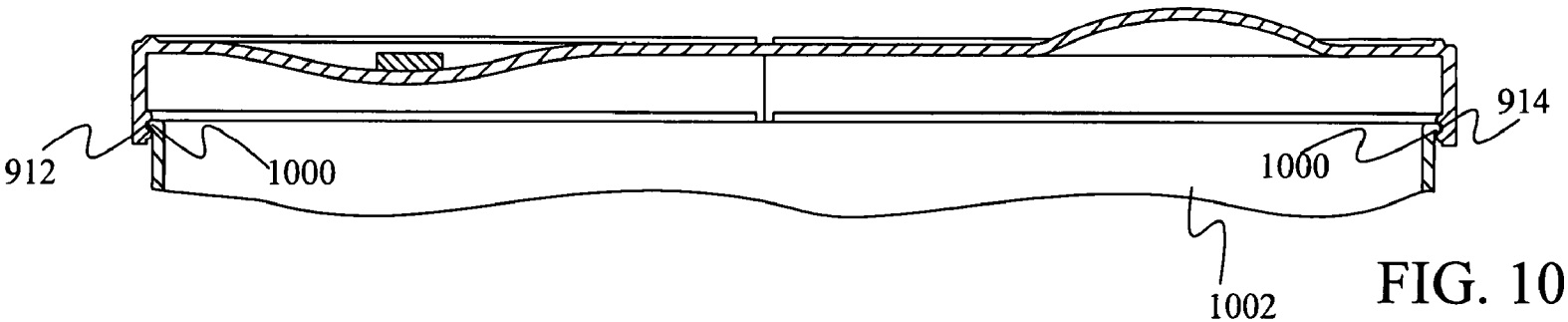
FIG. 10 is a cross-sectional view of a lid and container of one embodiment.

Skirt 106 is shown to include ribs 908 and 910 and skirt 108 is shown to include ribs 904 and 906. Ribs 908 and 910 extend around skirt 106 and terminate just before or at slit 110 and slit 310. Ribs 904 and 906 extend around skirt 108 and terminate just before or at slit 110 and slit 310. Ribs 904 and 906 define a groove 912 and ribs 908 and 910 define a groove 914. A lip of a container fits into grooves 912 and 914 to secure lid 102 to container 100 as shown in FIG. 10. In particular, in FIG. 10, lip 1000 formed on the outer circumference of the top of a container 1002 engages in grooves 912 and 914 and thus holds lid 102 in place on container 1002.

Although the invention has been described with respect to particular embodiments, such embodiments are for illustrative purposes only and should not be considered to limit the invention. Various alternatives and other modifications within the scope of the invention in its various embodiments will be apparent to those of ordinary skill.

What is claimed is:

1. A container lid for use with a container, the container lid comprising:

a top, substantially planar surface that is elongated to define two opposite longitudinal edges and two opposite lateral edges, wherein each of the two opposite lateral edges extends between and is shorter than each of the two longitudinal edges;

means for coupling with a top of the container, the means for coupling extending downwardly from and around a periphery of the top, substantially planar surface;

a ridge extending above the top, substantially planar surface near and substantially around a perimeter of the top, substantially planar surface;

a depressed area surrounded by and extending below the top, substantially planar surface;

a raised area surrounded by and extending above the top, substantially planar surface, wherein the raised area is positioned nearest one of the two opposite lateral edges, the depressed area is positioned nearest the other one of the two opposite lateral edges, the raised area defines a see-through window extending above the top, substantially planar surface a distance further than the ridge extends above the top, substantially planar surface, and the see-through window is the only see-through portion of the container lid; and a hinge area extending laterally across the top, substantially planar surface and positioned between the depressed area and the raised area, wherein the hinge area divides the top, substantially planar surface into two portions rotatable relative to one another about the hinge area;

wherein:

the top, substantially planar surface defines an overall width laterally defined between the two opposite longitudinal edges, the raised area and the depressed area each define a center, and the center of the raised area and the center of the depressed area are spaced apart a distance from one another that is greater than the overall width of the top, substantially planar surface.

2. The container lid of claim 1, wherein the raised area is positioned closer to the one of the two opposite lateral edges than to the depressed area.

3. The container lid of claim 1, wherein the raised area is positioned closer to the one of the two opposite lateral edges than to the hinge area.

4. The container lid of claim 1, wherein the raised area has a perimeter size and a perimeter shape substantially identical to a perimeter size and a perimeter shape of the depressed area.

5. The container lid of claim 1, in combination with the container having a top opening, the top, substantially planar surface being shaped similarly to the top opening.

6. A container lid for use with a container, the container lid comprising:

a top, substantially planar surface that is elongated to define two opposite longitudinal edges and two opposite lateral edges, wherein each of the two opposite lateral edges extends between and is shorter than each of the two longitudinal edges;

means for coupling with a top of the container, the means for coupling extending downwardly from and around a periphery of the top, substantially planar surface;

a depressed area surrounded by and extending below the top, substantially planar surface;

a raised area surrounded by and extending above the top, substantially planar surface, wherein the raised area is positioned nearest one of the two opposite lateral edges and the depressed area is positioned nearest the other one of the two opposite lateral edges; and a hinge area extending laterally across the top, substantially planar surface and positioned between the depressed area and the raised area, wherein the hinge area divides the top, substantially planar surface into two portions rotatable relative to one another about the hinge area; and a raised rim extending upwardly from the top, substantially planar surface and extending substantially around the depressed area and the raised area, wherein the raised area includes a see-through window extending above the top, substantially planar surface higher than any other portion of the container lid such that an observer of the container lid can view the see-through window from a side of the container lid when the top, substantially planar surface is positioned to extend substantially horizontally, and the see-through window is the only see-through portion of the container lid.

7. The container lid of claim 6, wherein the see-through window is centered relative to an outer perimeter of the raised area.

8. The container lid of claim 7, wherein the see-through window is transparent and is the only transparent portion of the container lid.

9. A combination comprising:

a container having a top opening;

a container lid comprising:

a top, substantially planar surface that is elongated to define two opposite longitudinal edges and two opposite lateral edges, wherein each of the two opposite lateral edges extends between and is shorter than each of the two longitudinal edges, and the top, substantially planar surface is shaped similarly to the top opening;

means for coupling with a top of the container, the means for coupling extending downwardly from and around a periphery of the top, substantially planar surface;

a depressed area surrounded by and extending below the top, substantially planar surface;

a raised area surrounded by and extending above the top, substantially planar surface, wherein the raised area is positioned nearest one of the two opposite lateral edges and the depressed area is positioned nearest the other one of the two opposite lateral edges;

a ridge extending upwardly from the top, substantially planar surface and substantially surrounding the depressed area and the raised area; and a hinge area extending laterally across the top, substantially planar surface and positioned between the depressed area and the raised area, wherein the hinge area divides the top, substantially planar surface into two portions rotatable relative to one another about the hinge area; and a consumable product maintained within the container, wherein:

the raised area of the container lid includes a see-through window extending further from the top, substantially planar surface than any other portion of the container lid, the consumable product is viewable through the see-through window of the raised area, which extends above the ridge, when the combination is viewed from a side with the top, substantially planar surface of the container lid being in a substantially horizontal position, and the see-through window is the only see-through portion of the container lid.

10. A lid for covering a container opening formed through a top portion of a container, the lid comprising:

an oblong planar region defining two opposing edges and an overall width defined between the two opposing edges;

a skirt extending around a periphery of the oblong planar region, wherein the skirt is configured to receive the top portion of the container and extend around the container opening to couple the lid to the container;

a first dome surrounded by and extending above the oblong planar region, the first dome defining a first dome center; and a second dome surrounded by and extending below the oblong planar region, the second dome defining a second dome center, wherein the first dome center and the second dome center are spaced apart a distance from one another that is greater than the overall width of the oblong planar region;

a ridge extending around both of the first dome and the second dome, the ridge extending above the oblong planar region;

wherein the first dome includes a domed transparent portion extending above the oblong planar region higher than any other portion of the lid such that an observer of the container lid can view the transparent portion from a side of the lid when the oblong planar region is positioned to extend substantially horizontally, and the domed transparent portion is the only transparent portion of the lid.

11. The lid of claim 10, wherein:

the two opposing edges are two opposing longitudinal edges extending between two opposing lateral edges of the lid, and the first dome is positioned closer to one of the two opposing lateral edges than to the second dome.

12. The lid of claim 10, wherein:

the two opposing edges are two opposing longitudinal edges extending between two opposing lateral edges of the lid, a linear hinge extends laterally across the oblong planar region between the two opposing longitudinal edges and is positioned between the first dome and the second dome, and the first dome is positioned closer to one of the two opposing lateral edges than to the linear hinge.

13. The lid of claim 10, wherein the transparent portion is centered relative an outer perimeter of the first dome.

14. The lid of claim 13, wherein the transparent portion is the only transparent portion of the lid.

15. The lid of claim 10, wherein the first dome has a perimeter size and a perimeter shape substantially identical to a perimeter size and a perimeter shape of the second dome.

16. The lid of claim 10, in combination with the container, the container defining the container opening, the oblong planar region being shaped similarly to the container opening.

17. The combination of claim 16, further comprising a consumable product maintained within the container, wherein the consumable product is viewable through the first dome when the combination is viewed from a side of the container with the oblong planar region of the lid being in a substantially horizontal position.

18. A lid for covering a container opening formed through a top portion of a container, the lid comprising:

a top, substantially planar surface that is oblong and defines:

two opposing longitudinal edges, two opposing lateral edges, each extending between and being shorter than each of the two opposing longitudinal edges, and an overall width extending between the two opposing longitudinal edges;

a skirt extending around and downwardly from a periphery of the top, substantially planar surface, wherein the skirt is configured to receive the top portion of the container and extend around the container opening to couple the lid to the container;

a depressed dome surrounded by and extending below the top, substantially planar surface, the depressed dome defining a depressed dome center; and a raised dome surrounded by and extending above the top, substantially planar surface, the raised dome defining a raised dome center, wherein:

the raised dome is positioned nearest one of the two opposing lateral edges and the depressed dome is positioned nearest the other one of the two opposing lateral edges, wherein the raised dome includes a substantially transparent window, and the substantially transparent window is the only substantially transparent portion of the lid; and the raised dome center and the depressed dome center are spaced apart a distance from one another that is greater than the overall width of the top, substantially planar surface;

a raised rim extending upwardly from the top, substantially planar surface along each of the two opposing longitudinal edges and the two opposing lateral edges, wherein the raised dome extends above the raised rim; and a hinge area extending laterally across the top, substantially planar surface between the depressed dome and the raised dome.

19. The lid of claim 18, in combination with the container and contents maintained within the container, wherein the contents are viewable through the substantially transparent window.

20. The lid of claim 18, wherein the raised dome and the depressed dome have substantially identical diameters, and the substantially identical diameters are each greater than about half the overall width of the top, substantially planar surface.

21. The lid of claim 20, wherein the substantially identical diameters are each greater than an overall length of top, substantially planar surface defined from one of the two opposing lateral edges to the other of the two opposing lateral edges.

22. The lid of claim 18, wherein the raised dome and the depressed dome have substantially identical diameters, and the substantially identical diameters are each greater than about three-quarters of the overall width of the top, substantially planar surface.

* * * * *